US005325986A

United States Patent [19]

Richardson et al.

[11] Patent Number: 5,325,986

[45] Date of Patent: Jul. 5, 1994

[54] BATHROOM ACCESSORIES

[75] Inventors: Jeffrey A. Richardson, Woodstock; Robert Orlando, Round Lake Beach, both of Ill.

[73] Assignee: R. A. Briggs & Company, Lake Zurich, Ill.

[21] Appl. No.: 932,349

[22] Filed: Aug. 19, 1992

Related U.S. Application Data

[62] Division of Ser. No. 641,606, Jan. 15, 1991, Pat. No. 5,165,567.

[51] Int. Cl.[5] ..... B65D 90/06

[52] U.S. Cl. ..... 220/400; 150/154; 206/389; 206/409; 206/457

[58] Field of Search ..... 150/154, 158, 165; 220/400, 903, 908, 910; 383/33, 43; 215/11.6, 12.1; 206/457, 494, 389, 409

[56] References Cited

U.S. PATENT DOCUMENTS

| | | | |
|---|---|---|---|
| 1,533,131 | 4/1925 | Muller | 206/457 |
| 1,819,122 | 8/1931 | Resnati | 206/494 X |
| 2,035,384 | 3/1936 | Hinchciff | 220/903 X |
| 2,201,779 | 5/1940 | Lathrop | 220/903 X |
| 2,319,384 | 5/1943 | Callan et al. | 383/33 X |
| 2,432,662 | 12/1947 | Gardner | 150/154 |
| 3,507,312 | 4/1970 | Petersen | 206/457 X |
| 3,704,776 | 12/1972 | Collins | 206/389 |
| 4,171,047 | 10/1979 | Doyle et al. | 206/494 X |
| 4,514,995 | 5/1985 | Curtis et al. | 150/154 X |

*Primary Examiner*—Bryon P. Gehman

*Attorney, Agent, or Firm*—Cooper & Dunham

[57] ABSTRACT

A bathroom accessory including a rigid plastic container, such as a wastebasket or facial tissue holder, and a washable, pleated cloth bag having a shape substantially conforming to the container. The container is placed inside of the pleated bag, and a retaining element is secured around the opening of the bag for disposition inwardly of the rim of the container to retain the bag on the container.

2 Claims, 2 Drawing Sheets

BATHROOM ACCESSORIES

This is a division of application Ser. No. 07/641,606, filed Jan. 15, 1991, now U.S. Pat. No. 5,165,567.

BACKGROUND OF THE INVENTION

The present invention relates generally to bathroom accessories such as wastebaskets, facial tissue holders, and the like, and more particularly to a bathroom accessory that includes a rigid body and a washable cloth cover that is readily detachable from the body.

It has become increasingly popular to decorate bathrooms with design-coordinated accessories, e.g. wastebaskets and other receptacles. It has also become fashionable to decorate the bathroom accessories with fabric to match window and shower curtains and/or towels. At the same time, it is desirable to keep the bathroom accessories clean with minimal effort and expense. It is further desirable to have bathroom accessories which are readily adaptable to changing decor, also with minimal effort and expense.

SUMMARY OF THE INVENTION

To this end, it is an object of the present invention to provide a bathroom accessory that can be easily coordinated with the decor of the bathroom.

It is another object of the present invention to provide a bathroom accessory which can be decorated with fabric of the same design as that of window and/or shower curtains.

It is a further object of the present invention to provide a bathroom accessory that includes a readily detachable and easily washable decorative cover.

It is another object of the present invention to provide a bathroom accessory that is readily adaptable to changing decor.

To these and other ends, the present invention broadly contemplates the provision of a bathroom accessory comprising a rigid container having side walls, a base at one end and a mouth at another end, the mouth including a rim portion; a decorative, washable cloth bag for covering the container, the washable cloth bag having an opening and a bottom, the shape of the bottom conforming to the base of the container, the bag also having pleated sides which conform to the side walls of the container; and retaining means attached to the opening of the bag and positionable inwardly of the rim of the container for retaining the bag around the container.

In a first embodiment, wherein (for example) the container is a wastebasket, the retaining means comprises an elongated, stiffly flexible element for resting against the inner walls of the container adjacent the rim portion, thereby securing the bag over the rim of the container, the flexible element having a length slightly greater than the circumference of the mouth of the container, and having opposed free ends; and fastening means for detachably connecting together the ends of the elongated element. In this embodiment, the opening of the bag has a vent formed near the ends of the elongated element for increasing the size of the opening when the ends of the elongated element are detached.

Advantageously or preferably, the fastening means comprises a plurality of flexible hook fasteners mounted on the bag adjacent one end of the elongated element and a plurality of flexible loop fasteners mounted on the bag adjacent the other end of the elongated element and disposed to engage the hook fasteners when the elongated element is in bag-securing position adjacent the container rim portion.

In a second embodiment, the retaining means comprises elastic for securing the bag over the rim of the container, the elastic having a circumference less than that of the mouth of the container. This embodiment may be adapted to serve as a facial tissue holder; in such case the base of the container has a slit formed therein, and the bottom of the bag has a slit formed therein for register with the slit formed in the container, the container being adapted to be inverted for covering a facial tissue dispenser box having a size slightly smaller than the size of the container, whereby tissues may be dispensed through the slits in the container and the bag. The slit formed in the bottom of the bag may be provided with a decorative trimming.

The above and other objects, features, and advantages of the present invention will become apparent from the following detailed description of preferred embodiments when read in conjunction with the accompanying drawings, in which the same reference numerals are used to identify the same or similar parts in the several views.

DETAILED DESCRIPTION

Figure 1:
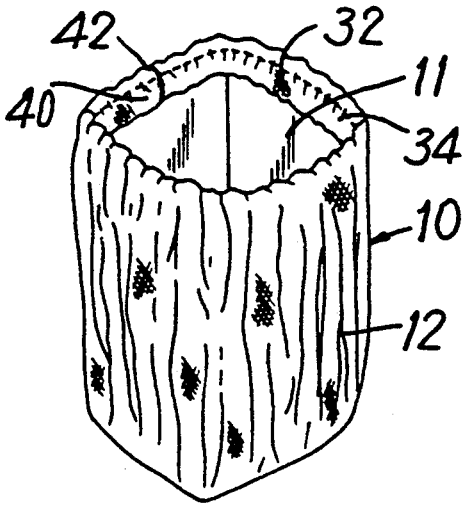
FIG. 1 is a perspective view from above of a bathroom wastebasket embodying the present invention in a particular form.

Referring first to FIGS. 1–5, the invention in the form there shown is embodied in a bathroom wastebasket 10 comprising a container or receptacle 11 and a cover 12. The container, best seen in FIG. 2, may be a generally conventional, rigid, unitary molded plastic wastebasket including a base **12*a* and side walls 14 formed integrally therewith, the side walls at their upper extremity having a rim portion 16 defining an open mouth 18 for receiving trash to be held within the wastebasket. As illustrated, the container is of generally square horizontal cross-section but has curved corners and somewhat arcuate, downwardly convergent walls; however, the container may be of any desired shape, e.g. cylindrical, rectangular in horizontal cross-section, etc. The rim portion 16** terminates upwardly in a simple rounded edge with no bead or flange.

The bag 12 (FIGS. 2 and 3) is a sack of any suitable washable textile fabric (e.g. a woven cloth), open at the top, and is shaped and dimensioned to receive the container 11 in surrounding, generally conforming relation to the base and side walls thereof. It includes a flat, single-ply fabric base panel 20, generally conforming in shape and size to the base of the container 11, and a single-ply fabric wall panel 22 stitched along its bottom margin to the periphery of base panel 20 at seam 24. The side edges of the wall panel are stitched together at seam 26, so as to constitute (with the base panel 20) a complete, upwardly opening sack. As indicated at 28, the fabric of the wall panel may be gathered or pleated vertically. The vertical dimension of the wall panel, measured upwardly from seam 24, is somewhat greater than the vertical dimension of the container walls 14.

An elongated, stiffly flexible retaining element 30 (FIG. 3), such as a generally ring-shaped flat strip or band of plastic, buckram or other washable material, is secured to the top of the bag. Specifically, this element 30 is mounted within a hem 32 (FIG. 2) formed by folding the top margin of wall panel 22 downwardly and inwardly (over the contained element 30) around almost the entire periphery of the top opening of the bag, and stitching as indicated at 34. The element 30 has opposed free ends 36; its length, when laid out flat, is slightly greater than the inner circumference of the rim portion 16 of the container 11. Between the free ends of the element 30, the top margin of the bag wall panel 22 is formed with a generally V-shaped notch or vent 38, to facilitate insertion of the container 10 into the bag and subsequent overlapping of the portions 40 of hem 32 respectively containing the two ends 36 of the element 30.

Figure 2:
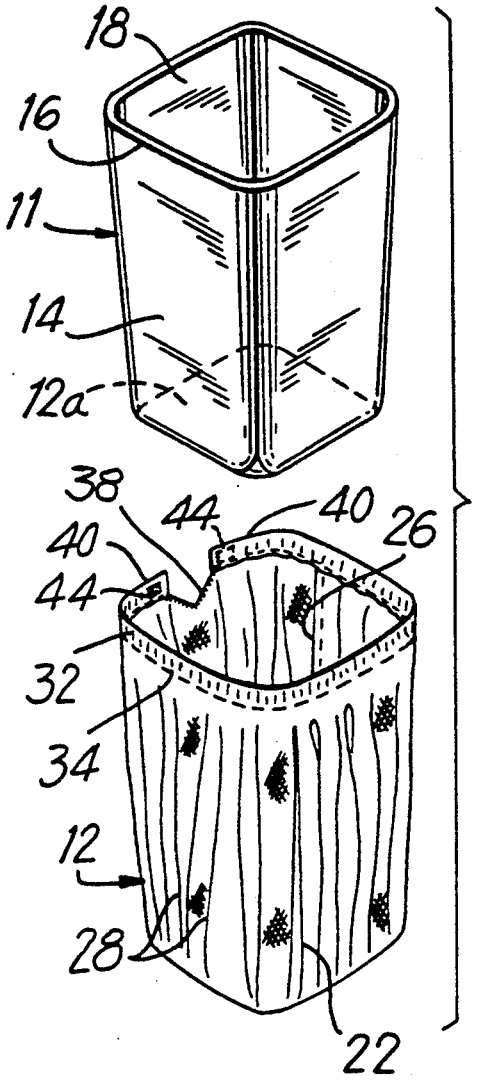
FIG. 2 is an exploded perspective view from above of the embodiment of FIG. 1.
Figure 3:
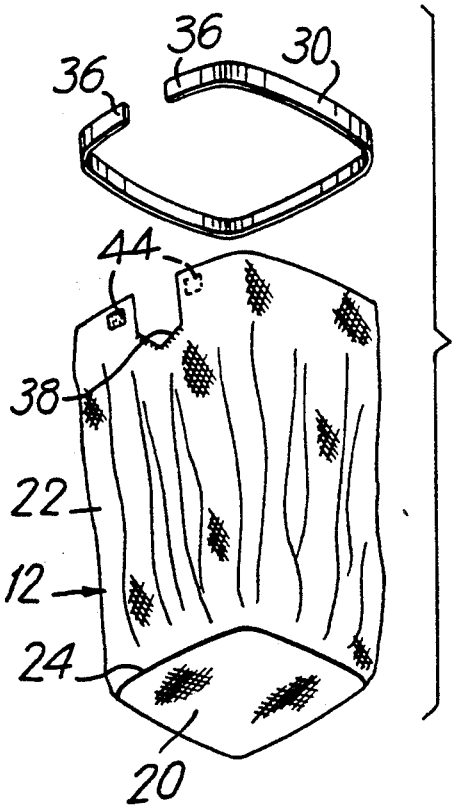
FIG. 3 is an exploded perspective view, from below, of the embodiment of FIG. 1.
Figure 4:
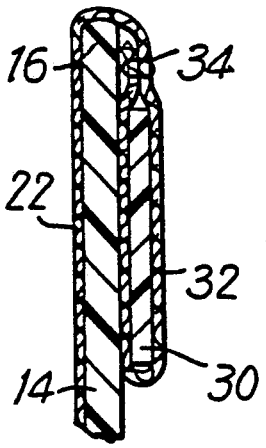
FIG. 4 is an enlarged fragmentary sectional view, in elevation, of a portion of the upper edge of the embodiment of FIG. 1.

As may be understood from a comparison of FIGS. 2 and 1, when the container 11 is inserted within the bag 12 through the open top thereof, the bag generally conforms to the container exterior but the hem 32 holding element 30 projects above the rim portion 16 of the container. The user now bends the hem 32 downwardly and inwardly over the container rim portion, so that the hem and element 30 lie flat against the inwardly-facing surface of the container wall adjacent the rim, as illustrated in FIGS. 1 and 4. Owing to the aforementioned relationship between the length of element 30 and the length of the container rim circumference, the two hem portions 40 (respectively containing the element ends 36) overlap at 42 when the hem and element are thus folded over the rim portion 16. This overlapping is permitted by the vent 38.

Figure 5:
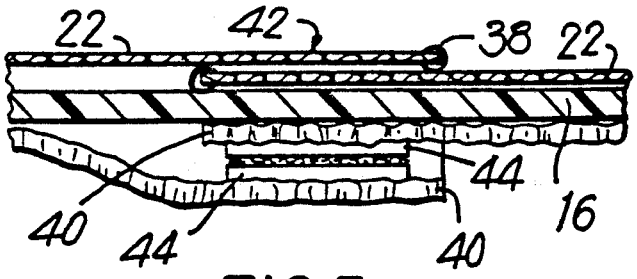
FIG. 5 is a fragmentary sectional plan view, from below, of the retaining means of the bag of FIG. 1, and associated elements.

A pair of cooperating washable fastening elements 44 of the type commercially available under the trade name "Velcro" are respectively secured to the two hem portions 40 of the bag (being thus respectively adjacent the two free ends of the retaining element 30) in such positions that they are in facing register with each other when the portions 40 overlap at 42, i.e., when the hem is folded downwardly and inwardly over the container rim as described above. These facing fastening elements 44 (one of which has a multiplicity of flexible hooks, and the other of which has a multiplicity of flexible loops engageable by the hooks) are pressed together by the user, as shown in FIG. 5, to secure the overlapped hem portions 40 together. The free ends 36 of the retaining element 30 are thus held in fixedly maintained overlapping relation, with the retaining element 30 bearing against the inner surface of the rim 16 around the entire periphery of the container, thereby to anchor the bag to the container.

When it is desired to remove the bag from the container, the fastening elements 44 are simply pulled apart manually, enabling the hem to be turned upwardly and outwardly. The container can then be lifted out of the bag. Since all components of the bag are washable, the bag may now be washed (e.g. in a household washing machine), dried, and remounted on the container by the procedure already described. In this way, the bag may easily be maintained in an attractively clean and sanitary condition.

Ordinarily the bag fabric will be colored or printed with a design, for example a fabric color or design also used on bathroom curtains, towels, other accessories, etc. If it is desired to change the bathroom to a new coordinated decor, the bag may simply be replaced with a new bag having the selected new color or design.

Figure 6:
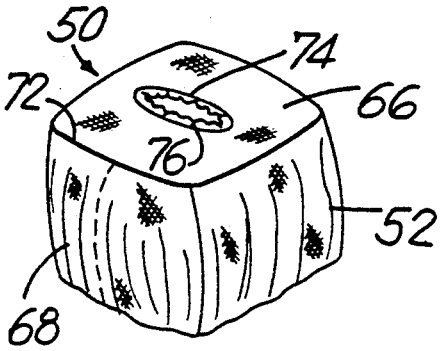
FIGS. 6 and 7 are perspective views, respectively from above and below, of another embodiment of the present invention.
Figure 7:
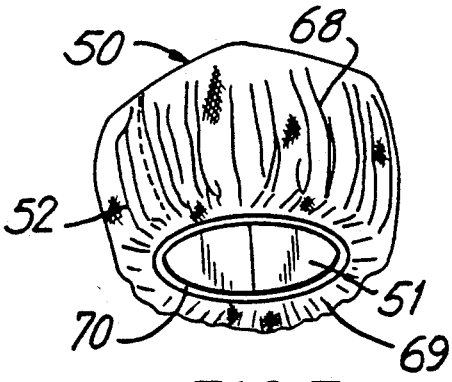
Figure 8:
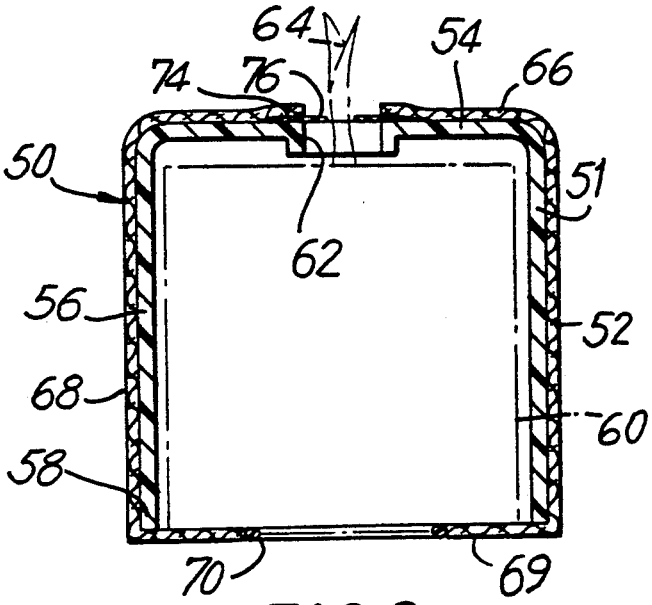
FIG. 8 is an enlarged elevational sectional view of the embodiment of FIGS. 6 and 7.

The invention may also be embodied in other bathroom accessories, as shown in FIGS. 6–8, wherein there is illustrated a facial tissue holder 50 comprising a generally conventional, unitary, rigid molded plastic receptacle 51 for facial tissue packages and a washable cloth bag 52. The receptacle 51, like the container 11 of FIGS. 1–5, has a base 54 and side walls 56 formed integrally therewith and terminating in a rim portion 58 defining an open mouth. In this instance, however, the mouth opens downwardly in use, being fitted over a disposable package 60 of facial tissues, and the now upwardly-facing base 54 is formed with a slit 62 to enable tissues 64 to be withdrawn from the box. The holder 50 functions to provide an attractive and protective enclosure for successive boxes of facial tissues.

In accordance with the invention in this embodiment, there is provided a washable cloth bag 64 having a flat single-ply fabric base panel 66 conforming generally in size and shape to the receptacle base 54, and a flat single-ply fabric wall panel 68 stitched to the base panel to surround the side walls 56 of the receptacle. Panels 66 and 68 cooperatively constitute an open-ended sack for receiving the receptacle 51.

At its margin 69 remote from base panel 66, the wall panel 68 is stitched (around its entire length) to an elastic ring 70 which serves as the retaining means for the bag 52. The vertical dimension of panel 68, measured from its seam 72 with the base panel, is greater than the height of receptacle walls 56. Consequently, when the receptacle is inserted within the bag 52, with its base 54 facing the bag base panel, the margin 69 of the bag wall panel 68 extends over and inwardly of the rim of the receptacle, being gathered by the elastic ring 70 as best seen in FIGS. 7 and 8. It will be understood that ring 70 is sufficiently stretchable to enable easy insertion or removal of the receptacle, but at the same time has such strength and dimensions as to hold the open end 69 of the bag stretched over the receptacle rim in the manner shown in FIG. 7 when the receptacle is inserted in the bag. The gathering effected by ring 70 cooperates with stitching of panel 68 at hem 72 to impart vertical pleats to the bag wall panel.

The bag base panel 66 is formed with a slit 74 disposed for register with the receptacle slit 62, to enable extraction of tissues. A decorative trim 76 of lace or other washable material may be stitched to the bag base panel around the edge of slit 74.

Bag 52 may be made of the same material as bag 12 in the embodiment of FIG. 1, to provide therewith a design-coordinated set of bathroom accessories. Each bag is easily removable, washable, and remountable (or replaceable, e.g. with other bags of different design). The pleated appearance of both, in the described embodiments, contributes to the desired design coordination.

It is to be understood that the invention is not limited to the features and embodiments hereinabove specifically set forth, but may be carried out in other ways without departure from its spirit.

I claim:

1. A bathroom accessory comprising:

a rigid container having side walls, a base at one end and a mouth at another end, the mouth including a rim;

a decorative, washable cloth bag for covering the container, the washable cloth bag having an opening and a bottom, the shape of the bottom conforming to the base of the container, the bag also having pleated sides which conform to the side walls of the container; and retaining means attached to the opening of the bag and positionable inwardly of the rim of the container for retaining the bag around the container, wherein the retaining means comprises elastic for securing the bag over the rim of the container, the elastic having a circumference less than that of the mouth of the container, wherein the base of the container includes a narrow, elongated opening formed therein, and the bottom of the bag includes a narrow, elongated opening formed therein in register with the elongated opening formed in the container, and wherein the container is adapted to be inverted for covering a facial tissue dispenser box having a size slightly smaller than the size of the container, whereby tissues may be dispensed through the openings in the container and the bag.

2. A bathroom accessory according to claim 1, wherein the opening formed in the bottom of the bag has a decorative trimming.

* * * * *